US006182322B1

(12) United States Patent
Tubman

(10) Patent No.: US 6,182,322 B1
(45) Date of Patent: Feb. 6, 2001

(54) BRUSH WITH ROTARY HEAD

(76) Inventor: Louis Tubman, 2301 Cherry St., Philadelphia, PA (US) 19102

( * ) Notice: Under 35 U.S.C. 154(b), the term of this patent shall be extended for 0 days.

(21) Appl. No.: 09/204,293

(22) Filed: Dec. 3, 1998

(51) Int. Cl.[7] ..... A46B 5/00; A46B 15/00; B25G 3/00

(52) U.S. Cl. ..... 15/172; 15/144.1; 15/145; 15/159.1; 15/176.1; 15/176.6; 403/326; 403/372

(58) Field of Search ..... 15/144.1, 145, 15/159.1, 172, 176.1, 176.6; 403/326, 372

(56) References Cited

U.S. PATENT DOCUMENTS 434,295 * 8/1890 Richardi .
3,060,555 * 10/1962 Kirshenbaum et al. .
4,457,038 * 7/1984 Hammond .
4,541,139 * 9/1985 Jones et al. .
4,642,836 * 2/1987 Bokmiller .
5,161,278 * 11/1992 Tomm .
5,172,447 * 12/1992 Tomm .
5,619,769 * 4/1997 Hutt .

FOREIGN PATENT DOCUMENTS

92/19125 * 11/1992 (WO) .

* cited by examiner

*Primary Examiner*—Timothy M. Speer
*Assistant Examiner*—Jennifer McNeil
(74) *Attorney, Agent, or Firm*—Aquilino, Welsh & Flaxman

(57) ABSTRACT

A rotary brush including an elongated handle and brush head and a rotary swivel joint between the handle and brush head allowing the brush to rotate to reach hard to access places when used for cleaning.

5 Claims, 2 Drawing Sheets

FIG. 2
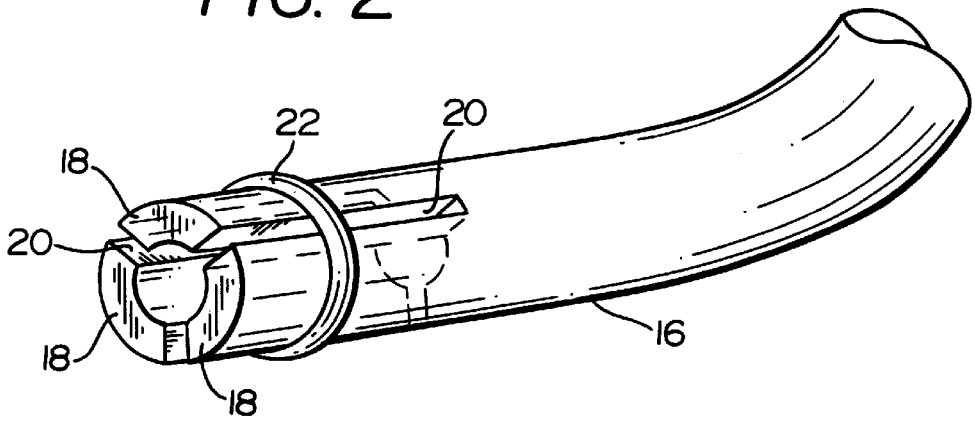
FIG. 4
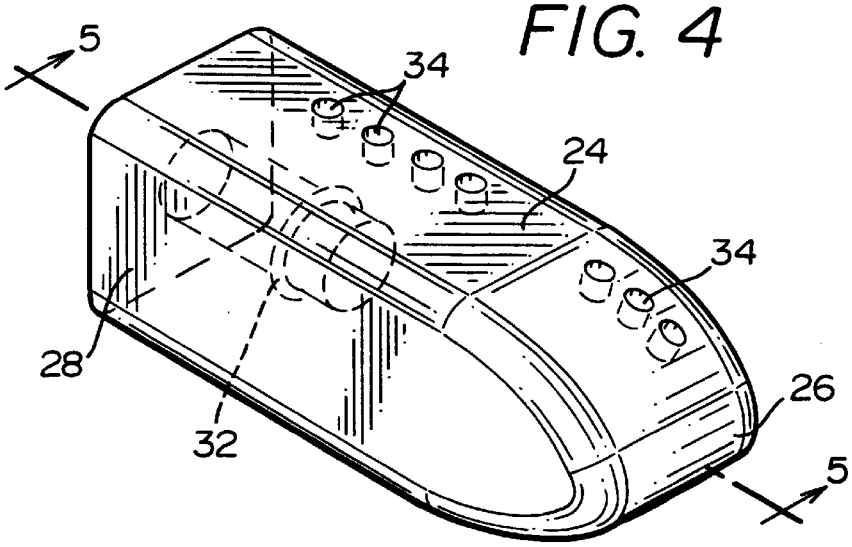
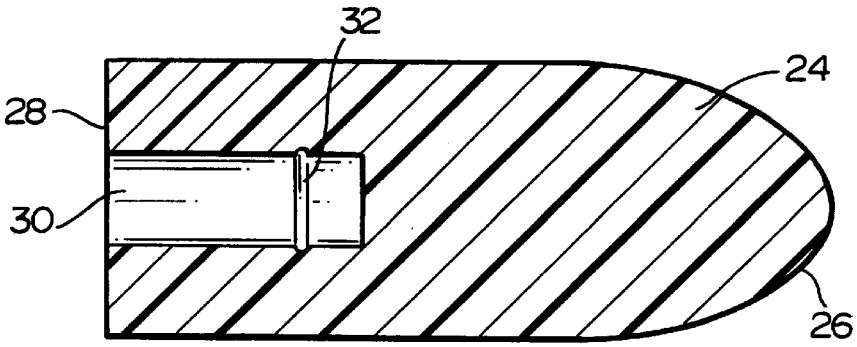
FIG. 5

BRUSH WITH ROTARY HEAD

BACKGROUND AND SUMMARY OF THE INVENTION

The present invention relates to a household cleaning brush and, in particular, to a brush having a swivelling head which rotates in order to reach hard to access areas.

Conventional household brushes find utility in kitchen and bathroom and other areas to be cleaned in a normal household. An example of this type of brush is shown in my own U.S. Design Patent 357,586, which shows a long handled brush having a generally rectangular block head design with the ends rounded. This and other similar brushes are designed to clean hard to reach areas, such as under the sink, behind tubs, toilet bowls, and the like.

The present invention relates to a similar brush which is specifically designed to access bathtubs and similar hard to reach areas. The brush is improved through the use of a rotating or swivelling head and unique connection between the head and the brush handle. The swivelling head allows a user to reach hard to access areas without having to manipulate the handle. This is particularly useful where there is little room in an area to be cleaned. This also aids people using the brush who may have limited physical abilities such as older and disabled individuals. The brush includes a unique rotating handle to brush head connection including a set of resilient arms and an annular o-ring connector which enables the brush head to easily rotate relative to the handle.

The length and shape of the handle provides distinctive anthropometric and ergonomic advantages that enables the user to efficiently and conveniently scrub and clean a bathtub eliminating extreme and awkward physical postures. The long handle and rotational brush movement allows a user to assume a minimal leaning position at the side of the bathtub resulting in the need of a minimal amount of arm and hand strength and flexibility to complete the cleaning operations. The torpedo shape and free rotating brush head scrubs and cleans as it is pushed across the surface accommodating the varied angles and curves found in a standard bathtub and it's surrounds.

Among the objects of the present invention is the provision of an improved brush design having a swivelling head to reach hard to access cleaning areas.

Another object is the provision of a brush structure which is more convenient and facile for cleaning a bathtub and it's surrounds while alleviating and reducing awkward and vigorous physical posturings heretofore required in the typical bathtub cleaning process.

Another object is the provision of a brush having a hand-to-floor length handle for increased efficiency and convenience in cleaning hard to access areas.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 2 is a view of the brush handle end showing the swivel connection.

FIG. 4 is a perspective view of the brush head without the bristles.

FIG. 5 is a sectional view taken along lines 5—5 of FIG. 4

DESCRIPTION OF THE PREFERRED EMBODIMENTS

Figure 1:
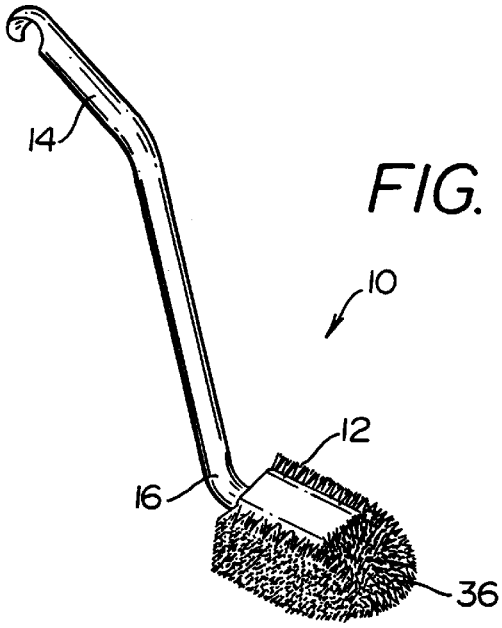
FIG. 1 is perspective view of a brush in accordance with the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Referring to the drawings, a brush 10 in accordance with the present invention includes a brush head 12 and an elongated handle 14 which allows the entire limits of a bathtub to be reached during the cleaning process. The handle 14 includes an angularly disposed end 16 for connection to the brush head 12. The end 16 of the handle 14 is a trifurcated structure formed of three resilient, arcuate shaped, arms 18 separated by elongated slots 20 which extend the entire length of the arms 18. A plastic O-ring 22 is circumferentially molded on the outside peripheral edges of the arms 18.

Figure 3:
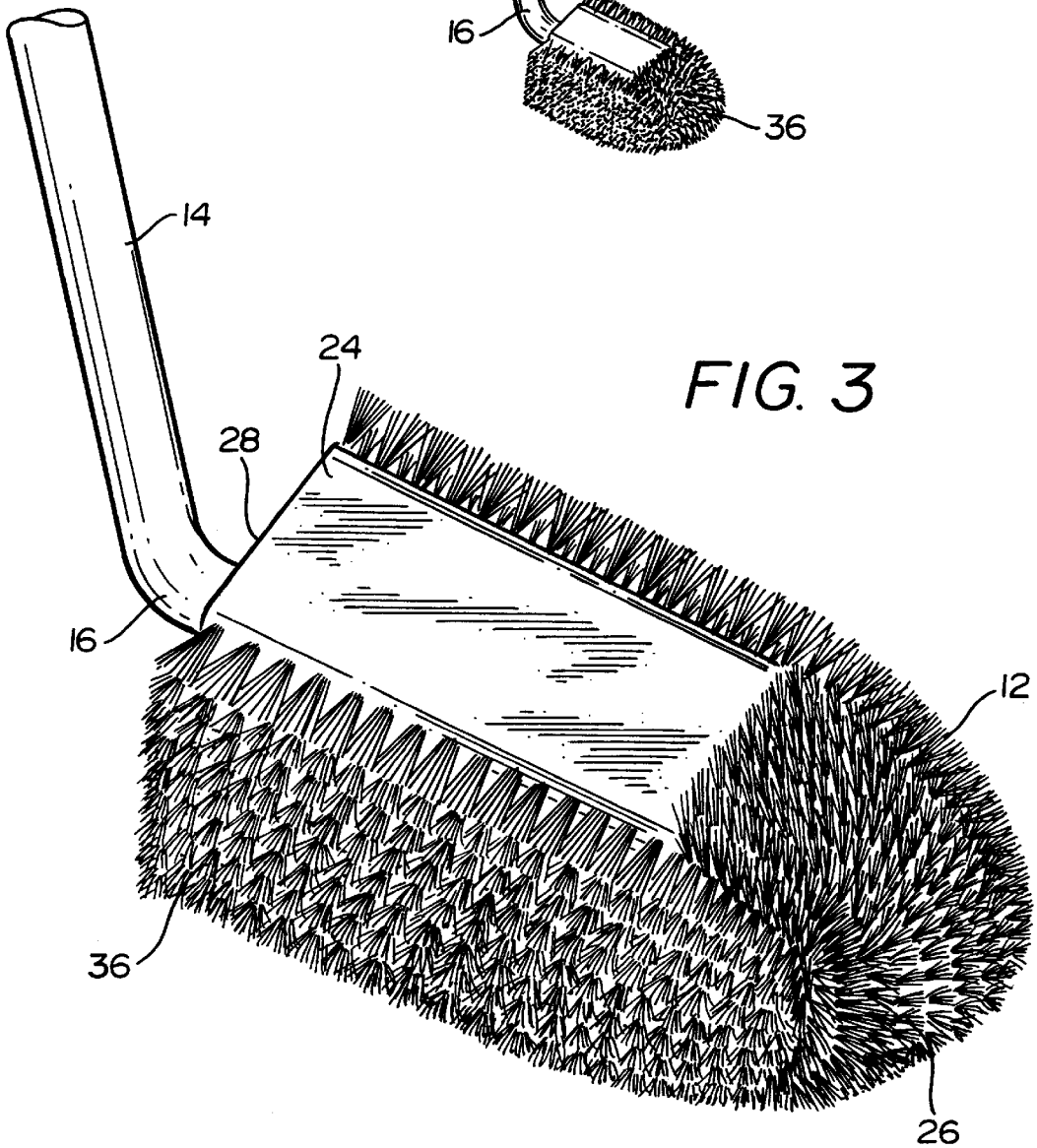
FIG. 3 is an enlarged perspective view of the brush head of FIG. 1.

A brush head 24 is torpedo shaped having a tapered front end 26 and a flat rear wall 28. An opening 30 molded into rear wall 28 of the brush head 24 extends longitudinally to the front end 26 and is sized to receive the handle end. The opening 30 includes an annular groove 32 located toward the closed end of the opening 30. The groove 32 is sized to receive the plastic O-ring 22 when the handle end 16 is inserted into the opening 30 and snaps in place by the interaction of the O-ring 22 and groove 32. This connection securely holds the handle and brush head together while permitting the brush head 24 to rotate relative to the handle 14. It will be appreciated that the brush head is provided with bristles 36, as shown in FIGS. 1 and 3, which are connected into holes 34 formed in the brush head 24.

In use the brush head 24 swivels with respect to the handle 14 due to the rotational movement between the O-ring 22 and the annular groove 32 enabling a user to reach hard to access areas when cleaning in, for example, kitchen and bathroom areas.

While various preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A rotary brush including a handle and brush head having a plurality of bristles wherein the improvement comprises:

a rotary joint between said brush head and said handle, said rotary joint formed of a plurality of resilient arms on an end of said handle, said arms being separated each from the other by an elongated slot defining the length of said arms, and further including an O-ring positioned circumferentially around said arms; said joint further including a cylindrical opening in said brush head and an annular groove in said cylindrical opening; said O-ring on said handle cooperating with said groove in said brush head permitting rotary movement therebetween.

2. The brush of claim 1 wherein said handle end is trifurcated forming three resilient arms at the end of said handle for insertion in said cylindrical opening.

3. The brush of claim 2 further including longitudinal slots separating said three resilient arms and extending the length thereof.

4. The brush of claim 2 wherein said three resilient arms are arcuate in shape.

5. The brush of claim 1 wherein said O-ring is integrally molded on said arms.

* * * * *